US007805988B2

(12) United States Patent
Kasperski et al.

(10) Patent No.: US 7,805,988 B2
(45) Date of Patent: Oct. 5, 2010

(54) BOREHOLE TESTER APPARATUS AND METHODS USING DUAL FLOW LINES

(75) Inventors: Bryan William Kasperski, Azle, TX (US); Margaret Cowsar Waid, Medicine Park, OK (US); Stanley Robert Thomas, Jr., Fort Worth, TX (US); Dennis Eugene Roessler, Houston, TX (US)

(73) Assignee: Precision Energy Services, Inc., Fort Worth, TX (US)

( * ) Notice: Subject to any disclaimer, the term of this patent is extended or adjusted under 35 U.S.C. 154(b) by 463 days.

(21) Appl. No.: 11/626,461

(22) Filed: Jan. 24, 2007

(65) Prior Publication Data

US 2008/0173083 A1 Jul. 24, 2008

(51) Int. Cl.
*E21B 49/00* (2006.01)

(52) U.S. Cl. ..... 73/152.23; 166/250.17; 166/264

(58) Field of Classification Search ..... 73/152.23
See application file for complete search history.

(56) References Cited

U.S. PATENT DOCUMENTS 4,962,815 A 10/1990 Schultz
6,301,959 B1 * 10/2001 Hrametz et al. ..... 73/152.23
7,013,723 B2 3/2006 Ramakrishnan et al.
7,380,599 B2 * 6/2008 Fields et al. ..... 166/264
2003/0206026 A1 11/2003 Diakonov et al.
2006/0243033 A1 11/2006 Freemark et al.

OTHER PUBLICATIONS

International Search Report and Written Opinion received in corresponding application No. PCT/US07/8221 dated May 5, 2008.

* cited by examiner

*Primary Examiner*—Hezron Williams
*Assistant Examiner*—Rodney T Frank
(74) *Attorney, Agent, or Firm*—Wong, Cabello, Lutsch, Rutherford & Brucculeri, L.L.P.

(57) ABSTRACT

A formation tester system with a tester tool comprising two or more functionally configured flow lines. The two or more functionally connected flow lines cooperating with one or more pumps and cooperating valves direct fluid to and from various axially disposed sections of the tester tool for analysis, sampling, and optionally ejection into the borehole or into the formation. The functionally connected flow lines extend contiguously through the sections of the tester tool. The functionally configured flow lines, cooperating with the one or more pumps and valves, can also direct fluid to and from various elements within a given tester tool section. Manipulation of fluid flows within the tester tool, as well as analysis, sampling and/or ejection operations, can be varied with the tester tool disposed in the borehole using appropriate commands from the surface of the earth.

20 Claims, 3 Drawing Sheets

BOREHOLE TESTER APPARATUS AND METHODS USING DUAL FLOW LINES

FIELD OF THE INVENTION

This invention is related to formation testing and formation fluid sampling. More particularly, the invention is related to the determination, within the borehole, of various physical properties of the formation or the reservoir and of the fluids contained therein using a downhole instrument or "tool" comprising dual, functionally configured fluid flow lines extending contiguously through various sections of the tool.

BACKGROUND

A variety of systems are used in borehole geophysical exploration and production operations to determine chemical and physical parameters of materials in the borehole environs. The borehole environs include materials, such as fluids or formations, in the vicinity of a borehole as well as materials, such as fluids, within the borehole. The various systems include, but are not limited to, formation testers and borehole fluid analysis systems conveyed within the borehole. In all of these systems, it is preferred to make all measurements in real-time and within instrumentation in the borehole. However, methods that collect data and fluids for later retrieval and processing are not precluded.

Formation tester systems are used in the oil and gas industry primarily to measure pressure and other reservoir parameters of a formation penetrated by a borehole, and to collect and analyze fluids from the borehole environs to determine major constituents within the fluid. Formation testing systems are also used to determine a variety of properties of formation or reservoir in the vicinity of the borehole. These formation or reservoir properties, combined with in situ or uphole analyses of physical and chemical properties of the formation fluid, can be used to predict and evaluate production prospects of reservoirs penetrated by the borehole. By definition, formation fluid refers to any and all fluid including any mixture of fluids.

Regarding formation fluid sampling, it is of prime importance that fluid collected for analysis represents virgin formation fluid with little contamination from fluids used in the borehole drilling operation. Various techniques have been used to minimize sample contamination including the monitoring of fluid pumped through a borehole instrument or borehole "tool" of the formation tester system until one and/or more fluid properties, such as resistivity, cease to change as a function of time. Other techniques use multiple fluid input ports combined with borehole isolation elements such as packers and pad probes to minimize fluid contamination. Flowing fluid through the tool is analyzed until it has been determined that borehole fluid contamination has been minimized, at which time the fluid can be retained within the tool and typically returned to the surface of the earth for more detailed chemical and physical analyses. Regarding in situ analyses of formation fluid, it is of prime importance that fluid collected for analysis represents virgin formation fluid with little contamination from fluids used in the borehole drilling operation.

Fluid analyses typically include, but are not limited to, the determination of oil, water and gas constituents of the fluid. Technically, it is desirable to obtain multiple fluid analyses or samples as a function of depth within the borehole. Operationally, it is desirable to obtain these multiple analyses or samples during a single trip of the tool within the well borehole.

Formation tester tools can be conveyed along the borehole by variety of means including, but not limited too, a single or multi-conductor wireline, a "slick" line, a drill string, a permanent completion string, or a string of coiled tubing. Formation tester tools may be designed for wireline usage or as part of a drill string. Tool response data and information as well as tool operational data can be transferred to and from the surface of the earth using wireline, coiled tubing and drill string telemetry systems. Alternately, tool response data and information can be stored in memory within the tool for subsequent retrieval at the surface of the earth.

Prior art formation tester tools typically comprise one dedicated fluid flow line cooperating with a dedicated pump to draw fluid into the formation tester tool for analysis, sampling, and optionally for subsequent exhausting the fluid into the borehole. As an example, a sampling pad is pressed against the wall of the borehole. A probe port or "snorkel" is extended from the center of the pad and through any mudcake to make contact with formation material. Fluid is drawn into the formation tester tool via a dedicated flow line cooperating with the snorkel. In order to isolate this fluid flow into the probe from fluid flow from the borehole or from the contaminated zone, fluid can be drawn into a guard ring surrounding the snorkel. The guard fluid is transported within the tester tool via a dedicated flow line and a dedicated pump. A more detailed description of the probe and guard ring methodology is presented in U.S. Pat. No. 6,301,959 B1, which is here entered into this disclosure by reference. This reference also discloses a dedicated flow line through which the snorkel fluid flows, and a dedicated flow line through which guard fluid flows. Fluid is sampled for subsequent retrieval at the surface of the earth, or alternately exhausted to the borehole via the dedicated flow lines and pump systems.

SUMMARY OF THE INVENTION

This disclosure is directed toward a formation tester tool comprising two or more functionally configured flow lines which, by using one or more pumps and cooperating valves, can direct fluid to and from various axially disposed sections of the tool for analysis, sampling, and optionally ejection into the borehole or into the formation. Functionally configured flow lines cooperating with the one or more pumps and valves can also direct fluid to and from various elements within a given tool section. Manipulation of fluid flows within the formation tester as well as analysis, sampling and/or ejection operations can be varied with the formation tester disposed in the borehole using appropriate commands from the surface of the earth. Basic concepts of the system are presented with the system embodied as a formation tester system.

The formation tester system comprises a formation tester tool that is conveyed within a well borehole by a conveyance apparatus cooperating with a connecting structure. The conveyance apparatus is disposed at the surface of the earth. The connecting structure that operationally connects the formation tester tool to the conveyance apparatus is a tubular or a cable. The connecting structure can serve as a data conduit between the tool and the conveyance apparatus. The conveyance apparatus is operationally connected to surface equipment, which provides a variety of functions including processing tool response data, controlling operation of the tool, recording measurements made by the tool, tracking the position of the tool within the borehole, and the like. Measurements can be made in real-time and at a plurality of axial positions or "depths" during a single trip of the tool in the borehole. Furthermore, a plurality of measurements can be made at a single depth during a single trip of the tool in the borehole.

The formation tester tool, in the illustrated embodiment, comprises a plurality of operationally connected functions such as, but not limited to, a packer section, a probe or port section, an auxiliary measurement section, a fluid analysis section, a sample carrier section, a pump section, a hydraulics section, an electronics section, and a telemetry section. Preferably each section is controlled locally and can be operated independently of the other sections. Both the local control and the independent operation are accomplished by a section processor disposed within each tool section. Fluid flows to and from elements within a tool section, and within the functionally configured dual flow lines, are preferably controlled by the section processor. The dual fluid flow lines preferably extend contiguously through the packer, probe or port tool, auxiliary measurement, fluid analysis, sample carrier, and pump sections of the tool. Functions of the tool sections will be discussed in detail in subsequent sections of this disclosure.

Fluid is preferably drawn into the tool through one or more probe or port sections using one or more pumps. Each tool section can comprise one or more intake or exhaust ports. Each intake port or exhaust can optionally be configured as a probe, guard, or borehole fluid intake port. As discussed above, borehole fluid contamination is minimized using one or more ports cooperating with borehole isolation elements such as a pad type device that is urged against the wall of the formation, or one or more packers.

Once pumped into the tool, fluid passes through either or both of the dual flow lines simultaneously up or down through other connected sections of the tool. This feature gives flexibility to the configuration of the various connected tool sections. Stated another way, the axial disposition of the sections operationally connected by the functionally configured dual flow lines can be rearranged depending upon a particular borehole task.

Since two flow lines are available, multiple tasks can be performed simultaneously. As an example, samples can be collected in the sample carrier section for subsequent retrieval at the surface of the earth, while oil, water and gas constituents are being measured with a spectrometer disposed in the fluid analysis section.

Overall formation tool length can be reduced by disposing a plurality of sensors on either or both flow lines.

BRIEF DESCRIPTION OF THE DRAWINGS

The manner in which the above recited features and advantages, briefly summarized above, are obtained can be understood in detail by reference to the embodiments illustrated in the appended drawings.

DETAILED DESCRIPTION OF THE PREFERRED EMBODIMENTS

Basic principles are disclosed in detail using an exemplary system embodied as a formation tester.

Figure 1:
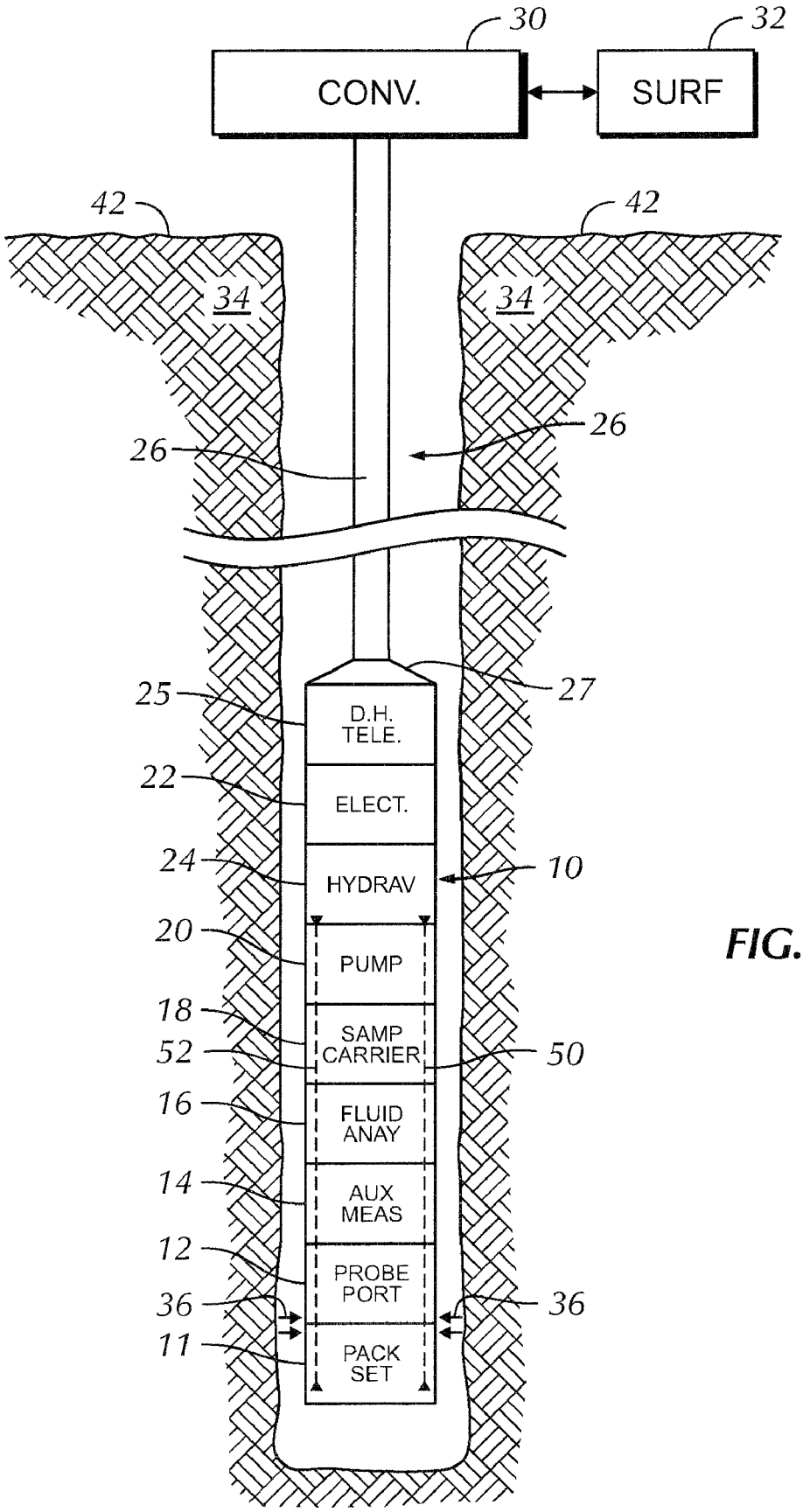
FIG. 1 illustrates conceptually the major elements of one embodiment of a formation tester system operating in a well borehole.

The formation tester system comprises a formation tester tool with functionally configurable dual flow lines. The formation tester tool is conveyed within a well borehole by any conveyance apparatus. FIG. 1 illustrates conceptually the major elements of an embodiment of a formation tester system operating in a well borehole 28 that penetrates earth formation 34. The embodiment of FIG. 1 is preferably an exemplary embodiment of a more general downhole fluid analysis device.

The formation tester borehole instrument or "tool" is denoted as a whole by the numeral 10. The tool 10 comprises a plurality of operationally connected sections including a packer section 11, a probe or port section 12, an auxiliary measurement section 14, a fluid analysis section 16, a sample carrier section 18, a pump section 20, a hydraulics section 24, an electronics section 22, and a downhole telemetry section 25. Two fluid flow lines 50 and 52 are illustrated conceptually with broken lines and extend contiguously through the packer, probe or port tool, auxiliary measurement, fluid analysis, sample carrier, and pump sections 11, 12, 14, 16, 18 and 20, respectively.

Again referring to FIG. 1, fluid is drawn into the tester tool 10 through a probe or port tool section 12. The probe or port section can comprise one or more intake ports, which are shown in subsequent illustrations. Fluid flow into the probe or port section 12 is illustrated conceptually with the arrows 36. During the borehole drilling operation, the borehole fluid and fluid within near borehole formation can be contaminated with drilling fluid typically comprising solids, fluids, and other materials. Drilling fluid contamination of fluid drawn from the formation 34 is typically minimized using one or more probes cooperating with a borehole isolation element such as a pad type device comprising a probe and a guard, as disclosed in previously referenced U.S. Pat. No. 6,301,959 B1. One or more probes extend from the pad onto the formation 34. Alternately, the formation can be isolated from the borehole by one or more packers (see FIG. 6) controlled by the packer section 11. A plurality of packers can be configured axially as "straddle" packers. Straddle packers and their use are disclosed in U.S. Pat. No. 5,337,621, which is incorporated into this disclosure by reference.

With the sections of the tool 10 configured in FIG. 1, fluid passes from the probe or port section 12 through one or both functionally configurable dual flow lines 50 and 52 under the action of the pump section 20. As will become apparent in subsequent sections of this disclosure, the pump section or a plurality of pump sections cooperating with other elements of the tool allows fluid to be transported, within the dual flow lines 50 and 52, upward or downward through various tool sections. The dual flow lines 50 and 52 also permit the simultaneous testing of two different zones.

The auxiliary fluid measurement can be made using auxiliary measurement section 14. The auxiliary measurement section 14 typically comprises one or more sensors (see FIG. 4) that measure various physical parameters of the fluid flowing within either or both of the flow lines 50 and 52. Elements and operation of the auxiliary measurement section will be discussed in a subsequent section of this disclosure.

The fluid analysis section 16 as illustrated in FIG. 1 is typically used to perform fluid analyses on the fluid while the tool 10 is disposed within the borehole 28. As an example, fluid analyses can comprise the determination of physical and chemical properties of oil, water and gas constituents of the fluid.

Again referring to the tool configuration shown in FIG. 1, fluid is directed via dual flow lines 50 and/or 52 to the sample carrier section 18. Fluid samples can be retained within one or more sample containers (see FIG. 3) within the sample carrier section 18 for return to the surface 42 of the earth for additional analysis. The surface 42 is typically the surface of earth formation or the surface of any water covering the earth formation.

Figure 5:
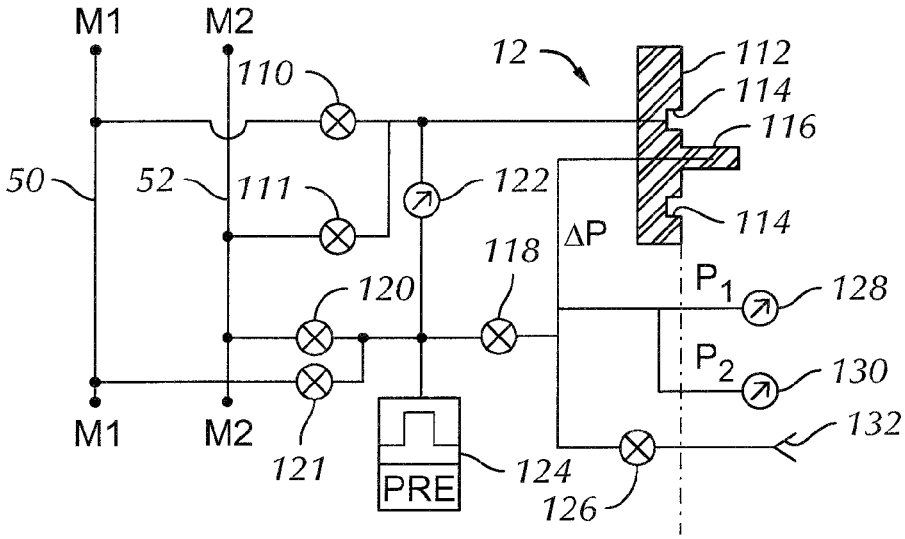
FIG. 5 is a functional diagram of major elements of the probe or port section of the tool.

The hydraulic section 24 depicted in FIG. 1 provides hydraulic power for operating numerous valves and other elements within the tool 10 (see FIG. 5).

The Electronics section 22 shown in FIG. 1 comprises necessary tool control to operate elements of the tool 10, motor control to operate motor elements in the tool, power supplies for the various section electronic elements of the tool, power electronics, an optional telemetry for communication over a wireline to the surface, an optional memory for data storage downhole, and a tool processor for control, measurement, and communication to and from the motor control and other tool sections. Preferably the individual tool sections optionally contain electronics (not shown) for section control and measurement.

Still referring to FIG. 1, the tool 10 can have an optional additional downhole telemetry section 25 for transmitting various data measured within the tool 10 and for receiving commands from surface 42 of the earth. The downhole telemetry section 26 can also receive commands transmitted from the surface of the earth. The upper end of the tool 10 is terminated by a connector 27. The tool 10 is operationally connected to a conveyance apparatus 30 disposed at the surface 42 by means of a connecting structure 26 that is a tubular or a cable. More specifically, the lower or "borehole" end of the connecting structure 26 is operationally connected to the tool 10 through the connector 24. The upper or "surface" end of the connecting structure 26 is operationally connected to the conveyance apparatus 30. The connecting structure 26 can function as a data conduit between the tool 10 and equipment disposed at the surface 42. If the tool 10 is a logging tool element of a wireline formation tester system, the connecting structure 26 represents a preferably multi-conductor wireline logging cable and the conveyance apparatus 30 is a wireline draw works assembly comprising a winch. If the tool 10 is a component of a measurement-while-drilling or logging-while-drilling system, the connecting structure 26 is a drill string and the conveyance apparatus 30 is a rotary drilling rig. If the tool 10 is an element of a coiled tubing logging system, the connecting structure 26 is coiled tubing and the conveyance apparatus 30 is a coiled tubing injector. If the tool 10 is an element of a drill string tester system, the connecting structure 26 is again a drill string and the conveyance apparatus 30 is again a rotary drilling rig.

Again referring to FIG. 1, surface equipment 32 is operationally connected to the tool 10 through the conveyance apparatus 30 and the connecting structure 26. The surface equipment 32 comprises a surface telemetry element (not shown), which communicates with the downhole telemetry section 25. The connecting structure 26 functions as a data conduit between the downhole and surface telemetry elements. The surface unit 32 preferably comprises a surface processor that optionally performs additional processing of data measured by sensors and gauges in the tool 10. The surface processor also cooperates with a depth measure device (not shown) to track data measured by the tool 10 as a function of depth within the borehole at which it is measured. The surface equipment 32 preferably comprises recording means for recording "logs" of one or more parameters of interest as a function of time and/or depth.

It is noted that FIG. 1 illustrates one embodiment of the formation tester tool 10, and this embodiment is used to disclose basic concepts of the system. It should be understood, however, that the various sections can be arranged in different axial configurations, and multiple sections of the same type can be added or removed as required for specific borehole operations.

Figure 2:
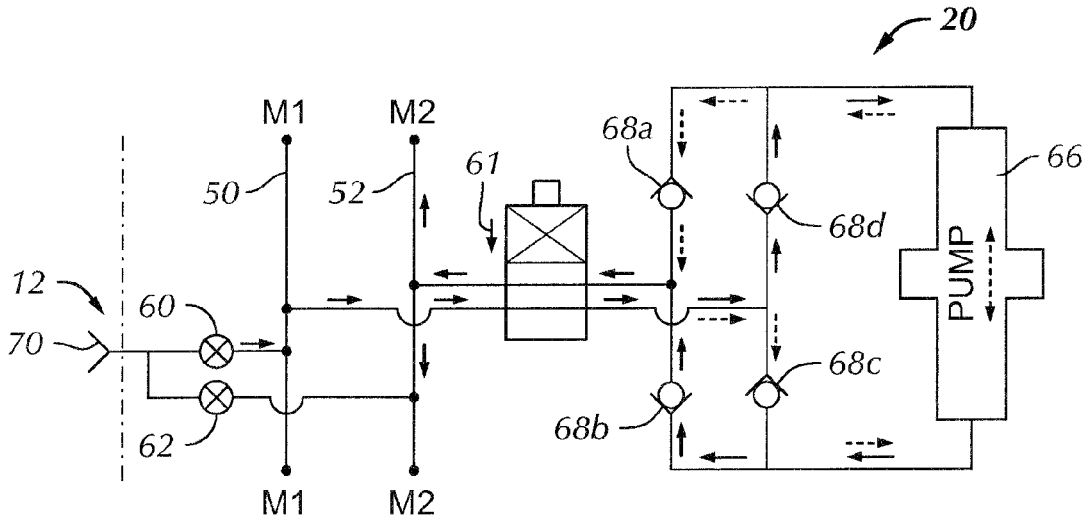
FIG. 2 is a functional diagram of major elements of the pump section of the downhole instrument or "tool"

FIG. 2 is a functional diagram of major elements of the pump section 20. As discussed previously, the pump section is used to draw formation fluid and/or borehole fluid into the tool 10, to distribute fluid independently to other sections of the tool 10 through the dual flow lines 50 and 52, and to optionally exhaust the fluid into the borehole 28. Fluid is drawn into or exhausted from the tool 10 into the borehole 28 through a port 70. The port 70 is a dedicated port to the borehole and preferably comprises a filter screen. Flow lines connect the port 70 with the tool's functionally configured dual flow lines M1 and M2, which are identified at 50 and 52, respectively. Fluid flow at the port 70 is controlled by two-way valves 60 and 62, as will be subsequently discussed. Briefly, the valves 60 and 62 are used only to connect the dual flow lines 50 and 52, respectively, to the borehole 28. Fluid is moved through the dual flow lines 50 and 52 preferably by a double acting piston pump 66. The pump 66 connects to the dual flow lines 50 and 52 through cooperating flow lines containing check valves 68*a*, 68*b*, 68*c*, and 68*d*, and a 4 way 2 position pilot valve 64. The check valves 68*a*, 68*b*, 68*c*, and 68*d* are shown schematically as spring loaded check valves. Alternate valve types can be used including pilot operated check valves, four-way valves, and the like. The four-way two-position pilot valve 64 is used as a flow reversal valve to allow the double acting piston pump 66 to either intake from the flow line 50 and exhausting to flow line 52, or to intake from flow line 52 and exhausting to flow line 50. This is one example of functional configurability of the dual flow lines M1 and M2 identified at 50 and 52, respectively.

It should also be understood that, with appropriate hardware such as straddle packers or probes, fluid can alternately be exhausted from the tool into the formation rather than into the borehole only. More specifically, fluid of certain properties may be injected into the formation as a stress test for determining formation mechanical properties. This information may subsequently be used in a variety of formation production operations including the design of formation fracture operations.

Still referring to FIG. 2, the pump 66 can intake or exhaust fluid from either of the dual flow lines 50 or 52. Fluid intake for the pump 66 can come remotely from various sections axially disposed up or down within the tool 10 via the dual flow lines 50 and 52, or come directly from the well borehole 28. Conversely, fluid exhaust can go remotely to various sections disposed axially up or down the tool 10 via the dual flow lines 50 and 52, or go directly to the well borehole 28 through the port 70. This fluid handling versatility is made possible by the dual flow lines 50 and 52 extending contiguously up and down through various sections of the tool 10, and the valves cooperating with the dual flow lines. If fluid is passing into the well borehole through the port 70, the valves 60 and 62 can be used to equalize pressure within the dual flow lines 50 and 52 throughout the tool.

One valve configuration will be used to illustrate the function of the pump section 11 as a means for moving fluid within the dual flow lines 50 and 52. It is emphasized that this is only an illustrative example, and the pump section 11 can be used to move fluid is a variety of ways. As the piston of the pump 66 moves upward, fluid flows in relation to the check valves 68*a*, 68*b*, 68*c*, and 68*d* in a direction indicated by the broken arrows. As the piston of the pump 66 moves down, fluid flows in relation to the check valves 68*a*, 68*b*, 68*c*, and 68*d* in a direction indicated by the solid arrows. With valve 60 open, valve 62 closed and the four-way two-position pilot valve 64 set as shown, fluid is drawn into the tool through the port 70, and a flow is induced upward and downward in the flow line 52. With valve 60 open, valve 62 closed and the four-way two-position pilot valve 64 set in a second position as indicated conceptually with the arrow 51, fluid is drawn into the tool through the port 70 and a flow is induced upward and downward in the flow line 50.

Figure 3:
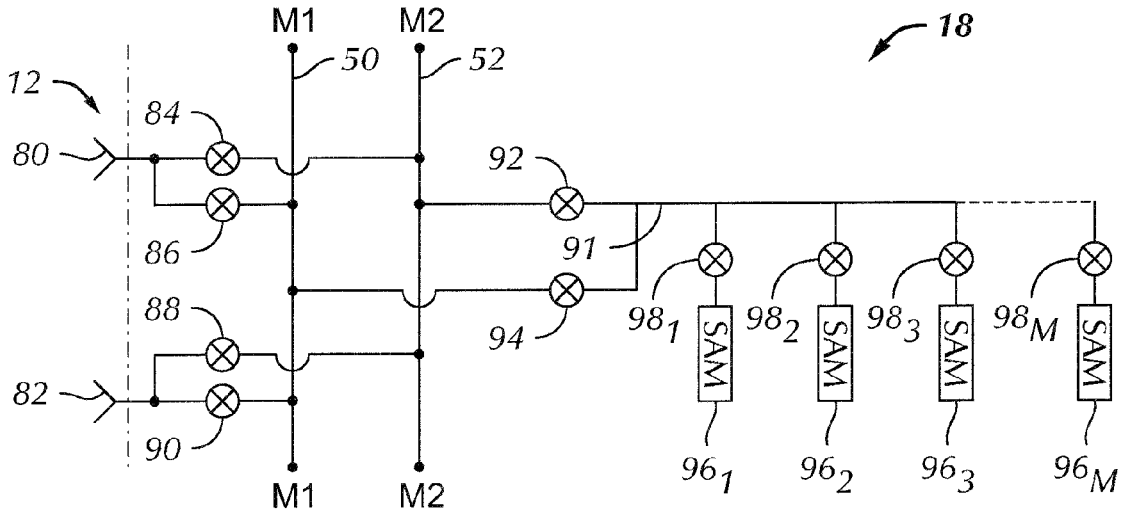
FIG. 3 is a functional diagram of major elements of the sample carrier section of the tool.

FIG. 3 is a functional diagram of major elements of the sample carrier section 18 of the tool 10. Two ports 80 and 82 are illustrated with cooperating valves 84, 86, 88, and 90, respectively. As in the functional diagram of FIG. 2, the ports 80 and 82 are connected by cooperating auxiliary flow lines, as shown, to the dual flow lines 50 and 52. The dual flow lines 50 and 52 are connected to a sample trunk flow line 91 with intervening valves 92 and 94. Sample containers or sample "bottles" $\mathbf{96}_1$, $\mathbf{96}_2$, $\mathbf{96}_3$, . . . $\mathbf{96}_n$ are connected via flow lines through intervening valves $\mathbf{98}_1$, $\mathbf{98}_2$, $\mathbf{98}_3$, . . . $\mathbf{98}_n$ to the sample trunk flow line 91. The number of sample bottles "n" is typically limited by available space for the bottles and cooperating flow lines and valves. From previous discussion of the pump section shown in FIG. 2, it is apparent that flow in either flow line 50 or 52 can be controlled independently. Furthermore, with the dual port arrangement shown in FIG. 3, it is apparent that fluid can be transported to and from the tool 10 from two different regions, such as the borehole and the formation. By setting the two-way valves 84, 86, 88, 90 92 and 94 in appropriate positions, fluid flows in either flow line 50 or 52. Furthermore, sampling can be done for fluid flowing either upward or downward in the either dual flow line 50 or 52. Sampling can also be performed simultaneously and independently from both dual flow lines 50 and 52. The setting of valves $\mathbf{98}_1$, $\mathbf{98}_2$, $\mathbf{98}_3$, . . . $\mathbf{98}_n$ to "open" or "closed" determines which cooperating sample bottle $\mathbf{96}_1$, $\mathbf{96}_2$, $\mathbf{96}_3$, . . . $\mathbf{96}_n$ is filled. The sample bottles are typically removed for additional analysis when the tool 10 is retrieved at the surface of the earth.

Figure 4:
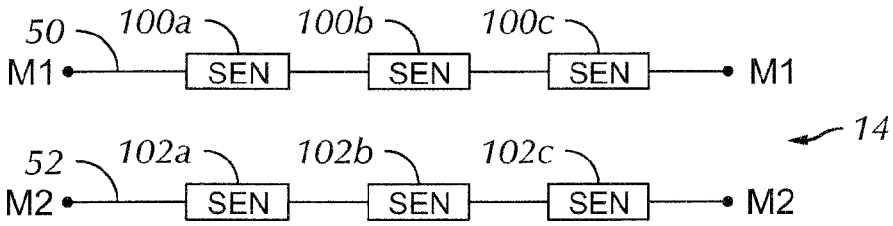
FIG. 4 is a functional diagram of major elements of the auxiliary measurement section of the tool.

FIG. 4 is a functional diagram of major elements of the auxiliary measurement section 14 of the tool 10. A plurality of sensors 100*a*, 100*b*, and 100*c* cooperates with dual flow line 50 to measure a variety of properties of the fluid flowing within the flow line. Only three sensors are shown for clarity. A plurality of sensors 102*a*, 102*b*, and 102*c* cooperates with dual flow line 52 to measure a variety of properties of the fluid flowing within this flow line. Again, only three sensors are shown for clarity. The sensors are responsive to properties of the fluid. Sensors can be the same type or different type on each flow line. As an example, if flow line 50 contains formation fluid and flow line 52 contains fluid drawn from the borehole, it may be of operational interest to measure the fluid dielectric constant or the resistivity. As in the discussion of other tool sections, flow within the dual flow lines 50 and 52 can be upward or downward thereby coming from tool sections below or above the auxiliary measurement section 14.

FIG. 5 is a functional diagram of major elements of the probe or port section 12 of the tool 10. A sampling pad 112 comprises a snorkel port 116 and a guard port 114 surrounding the probe. Fluid is drawn from formation, with the pad 112 abutting the wall of the borehole, through the snorkel 116. Guard fluid is drawn through the guard port 114. Depending upon the settings of the two-way valves 110, 111, 118, 120, 121 and 126, the formation and guard fluid flows can be directed to either dual flow line 50 or 52. By opening valves 118 and 120 and closing valves 126, 110, 120 and 111, formation fluid flows to flow line 52. Conversely, by opening valves 118, 121 and optionally 110 and closing valves 126, 111 and 120, formation fluid flows to flow line 50. By opening valves 110 and optionally valve 121 and closing valves 126, 111, 118 and 120, flow from the guard port 114 is directed to flow line 50. Conversely, by opening valves 111 and optionally 120 and closing valves 126, 110, 121 and 118, flow from the guard port 114 is directed to flow line 52. By closing valves 126, 110, 111, 121 and 120 and opening valve 118, formation fluid can be directed to a pretest chamber 124. Formation fluid can also be exhausted to the borehole through valve 126 and port 132. The above examples illustrate how the dual flow lines can be functionally configured. Other functional configurations can be used. It is apparent that fluid flows from the guard and from the snorkel are completely independent using the functionally configurable dual flow line methodology, and the flows can be directed to the flow lines or to an exhaust port by the settings of the various valves. Valves can be controlled from the surface thereby allowing fluid flows to be altered while the tool is within the borehole. Differential pressure between the snorkel and the guard is measured by the differential pressure gauge 122, and absolute pressure on the snorkel is measured by the pressure gauges 128 and 130. Once again, it is noted that flow within the functionally configured dual flow lines 50 and 52 can be upward or downward to other axially disposed sections in the tool 10.

Figure 6:
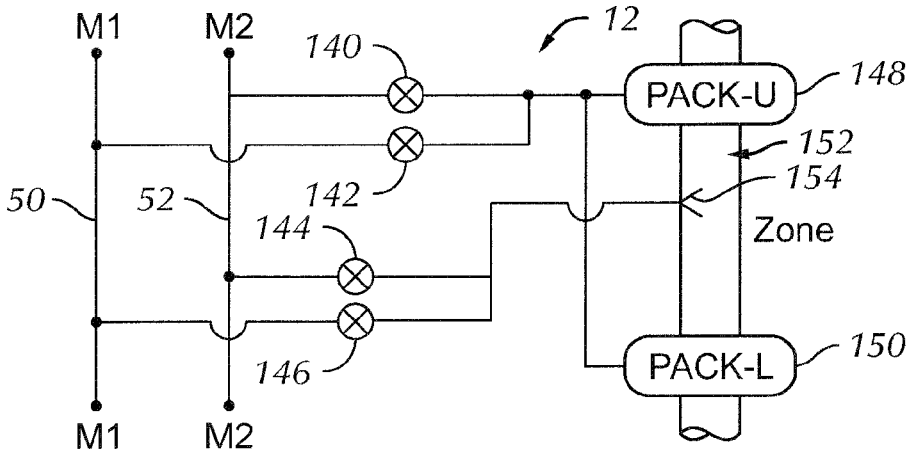
FIG. 6 is a functional diagram of major elements of a dual flow line packer section of the tool.

FIG. 6 is a functional diagram of major elements of a dual flow line packer section 11 of the tool 10. A straddle packer is illustrated conceptually and comprises an upper packer 148 and a lower packer 150 hydraulically isolating a zone 152. The upper and lower packers 148 and 150 cooperate with the dual flow lines 50 and 52 via auxiliary flow lines comprising two-way valves 140, 142, 144 and 146. Upon study of the functional diagram, it will become apparent that the packers 148 and 150 can be inflated or deflated using flows in either dual flow line 50 or 52, depending upon the settings of the two-way valves 140, 142, 144 and 146. Fluid from the isolated zone 154 can be drawn into the tool through the port 154 and directed to either dual flow line depending upon the settings of the valves 140, 142, 144 and 146. Inflation or deflation of the packers 148 and 150, and simultaneous flow from the isolated zone 152, requires an additional fluid pump (not shown) in the pump section 20. Furthermore the addition of an additional pump in the pump section 20 would increase packer flow as well as flow from the isolated zone 152. It is again noted that flow within the dual flow lines 50 and 52 can be upward or downward from the packer section 11 to other axially disposed sections in the tool 10.

SUMMARY

The formation tester tool comprising two flow lines cooperating with one or more pumps and a plurality of valves. The flow lines are functionally configured to cooperate with the plurality of valves to selectably establish hydraulic communication between two or more elements within the formation tester tool. More specifically, the dual flow lines can be functionally configured to direct fluid to various sections of the tool for analysis, sampling, multiple zone testing, packer inflation and optionally ejection into the borehole or injection into the formation. The flow lines are also incorporated to form fluid flow paths to various elements within a given tool section. The dual flow lines preferably extend contiguously through the packer, probe or port, auxiliary measurement, fluid analysis, sample carrier, and pump sections of the tool. Once pumped into the tool, fluid passes through either flow line simultaneously up or down through other axially connected sections of the tool. This feature gives flexibility to the configuration of the various connected tool sections. Since two flow lines are available, multiple tasks can be performed simultaneously. Overall formation tool length is reduced by disposing a plurality of sensors on both flow lines.

While the foregoing disclosure is directed toward the preferred embodiments of the invention, the scope of the invention is defined by the claims, which follow.

What is claimed is:

1. A formation tester tool comprising:

(a) a first functionally configured flow line;

(b) a second functionally configured flow line;

(c) at least one pump; and (d) a plurality of valves; wherein (i) said first and said second functionally configured flow lines cooperate with said plurality of valves and said at least one pump to establish hydraulic communication between a plurality of sections of said formation tester tool;

(ii) said sections are arrangable in different axial configurations, and (iii) multiple said sections can be added or removed in said tool as required for specific borehole operations.

2. The tool of claim 1 further comprising a plurality of said sections through which and fluid passes through either or both of said functionally configured flow lines and optionally passes up or down through said plurality of said sections.

3. The tool of claim 2 wherein one said section is a probe or port section comprising a probe port and a guard port, wherein fluid flows into said probe port and into said guard port are selectably directed to said first or said second functionally configured flow line.

4. The tool of claim 3 further comprising:

(a) an analysis section hydraulically cooperating with said first and said second functionally configured flow lines; and (b) a sample section hydraulically cooperating with said first and said second functionally configured flow lines; wherein (c) said fluid flow from said probe port or fluid flow from said guard port is transported to said analysis section or said sample section via said first or said second functionally configured flow line.

5. The tool of claim 4 wherein valves comprising said plurality of valves are set so that said fluid flow from said probe port and from said guard port are transported simultaneously to said analysis section and to said sample section.

6. The tool of claim 3 further comprising telemetry between said tool and the surface of the earth wherein distribution of said fluid flow from said probe port or from said guard port is selectably directed to said first or to said second functionally configured flow line via a command from the surface of the earth and while said tool is disposed in a borehole.

7. A method for testing in a borehole, the method comprising:

(a) disposing within said borehole a formation tester tool comprising a first functionally configured flow line and a second functionally configured flow line, at least one pump, and a plurality of valves;

(b) configuring said first and said second functionally configured flow lines to cooperate with said plurality of valves and said at least one pump to establish hydraulic communication between a plurality of sections of said formation tester tool; wherein (i) said first and said second functionally configured flow lines cooperate with said plurality of valves and said at least one pump to establish hydraulic communication between said plurality of said sections of said formation tester tool, (ii) said sections are arrangable in different axial configurations, (iii) multiple said sections can be added or removed in said tool as required for specific borehole operations; and (c) obtaining said testing from a response of at least one said one or more elements to said hydraulic communication.

8. The method of claim 7 further comprising:

(a) operationally connecting a plurality of sections within said formation tester tool;

(b) contiguously extending said first and said second functionally configured flow lines through said sections and;

(c) optionally passing fluid through either or both of said functionally configured flow lines and simultaneously passing fluid up or down through said plurality of said sections.

9. The method of claim 8 further comprising:

(a) configuring one said section as a probe or port section comprising a probe port and a guard port; and (b) selectably directing fluid flows into said probe port and into said guard port to said first or said second functionally configured flow line.

10. The method of claim 9 further comprising:

(a) providing an analysis section hydraulically cooperating with said first and said second functionally configured flow lines;

(b) providing a sample section hydraulically cooperating with said first and said second functionally configured flow lines; and (c) transporting said fluid flow from said probe port or fluid flow from said guard port to said analysis section or to said sample section via said first or said second functionally configured flow line.

11. The method of claim 10 further comprising setting valves comprising said plurality of valves so that said fluid flow from said probe port and fluid flow from said guard port are transported simultaneously to said analysis section and to said sample section.

12. The method of claim 9 further comprising selectably directing distribution of said fluid flow from said probe port or from said guard port to said first or to said second functionally configured flow line via a command telemetered from the surface of the earth and while said tool is disposed within said borehole.

13. The method of claim 7 further comprising operationally connecting said formation tester tool to a conveyance apparatus using a connecting structure.

14. The method of claim 13 wherein said connecting structure is a tubular.

15. The method of claim 14 wherein said conveyance apparatus is a drilling rig and said tubular is a drill string.

16. A formation tester system comprising:

(a) a formation tester tool comprising a first functionally configured flow line, a second functionally configured flow line, at least one pump, and a plurality of valves, wherein said first and said second functionally configured flow lines cooperate with said plurality of valves and said at least one pump to establish hydraulic communication between a plurality of sections of said formation tester tool, said plurality of sections are arrangable in different axial configurations, and multiple said sections can be added or removed in said tool as required for specific borehole operations;

(b) a conveyance apparatus; and (c) a connecting structure operationally connecting said formation tester tool to said conveyance apparatus to convey said formation tester tool in a borehole.

17. The system of claim 16 wherein said formation tester tool further comprising a plurality of said sections through which fluid passes through either or both of said functionally configured flow lines simultaneously and optionally passes up or down through said plurality of said sections.

18. The system of claim 16 wherein said first and said second functionally configured flow lines cooperate with said plurality of valves and said at least one pump to simultaneously test fluid from a plurality of zones.

19. The system of claim 16 wherein said connecting structure comprises a tubular.

20. The system of claim 18 wherein said conveyance apparatus comprises a drilling rig and said tubular comprises a drill string.

* * * * *

US007805988C1

(12) INTER PARTES REEXAMINATION CERTIFICATE (605th)

United States Patent
Kasperski et al.

(10) Number: US 7,805,988 C1
(45) Certificate Issued: May 24, 2013

(54) BOREHOLE TESTER APPARATUS AND METHODS USING DUAL FLOW LINES

(75) Inventors: Bryan William Kasperski, Azle, TX (US); Margaret Cowsar Waid, Medicine Park, OK (US); Stanley Robert Thomas, Jr., Fort Worth, TX (US); Dennis Eugene Roessler, Houston, TX (US)

(73) Assignee: Precision Energy Services, Inc., Fort Worth, TX (US)

Reexamination Request:
No. 95/001,756, Sep. 14, 2011

Reexamination Certificate for:

| | |
|---|---|
| Patent No.: | **7,805,988** |
| Issued: | **Oct. 5, 2010** |
| Appl. No.: | **11/626,461** |
| Filed: | **Jan. 24, 2007** |

(51) Int. Cl.
*E21B 49/10* (2006.01)

(52) U.S. Cl.
USPC ..... 73/152.23; 166/250.17; 166/264

(58) Field of Classification Search
None
See application file for complete search history.

(56) References Cited

To view the complete listing of prior art documents cited during the proceeding for Reexamination Control Number 95/001,756, please refer to the USPTO's public Patent Application Information Retrieval (PAIR) system under the Display References tab.

*Primary Examiner* — Anjan Deb

(57) ABSTRACT

A formation tester system with a tester tool comprising two or more functionally configured flow lines. The two or more functionally connected flow lines cooperating with one or more pumps and cooperating valves direct fluid to and from various axially disposed sections of the tester tool for analysis, sampling, and optionally ejection into the borehole or into the formation. The functionally connected flow lines extend contiguously through the sections of the tester tool. The functionally configured flow lines, cooperating with the one or more pumps and valves, can also direct fluid to and from various elements within a given tester tool section. Manipulation of fluid flows within the tester tool, as well as analysis, sampling and/or ejection operations, can be varied with the tester tool disposed in the borehole using appropriate commands from the surface of the earth.

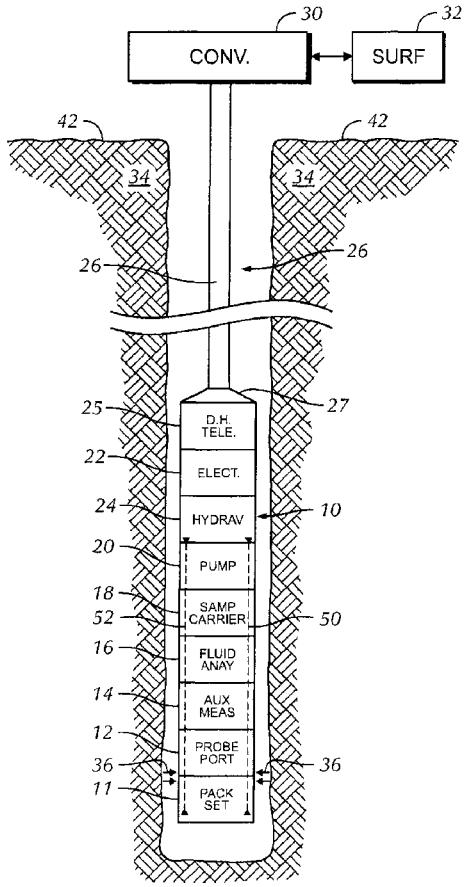

INTER PARTES REEXAMINATION CERTIFICATE ISSUED UNDER 35 U.S.C. 316

THE PATENT IS HEREBY AMENDED AS INDICATED BELOW.

AS A RESULT OF REEXAMINATION, IT HAS BEEN DETERMINED THAT:

Claims 1-20 are cancelled.

* * * * *